US007894759B2

(12) United States Patent
Yagi

(10) Patent No.: US 7,894,759 B2
(45) Date of Patent: Feb. 22, 2011

(54) IMAGE FORMING APPARATUS

(75) Inventor: Masataka Yagi, Okazaki (JP)

(73) Assignee: Konica Minolta Business Technologies, Inc, Tokyo (JP)

( * ) Notice: Subject to any disclaimer, the term of this patent is extended or adjusted under 35 U.S.C. 154(b) by 456 days.

(21) Appl. No.: 12/132,348

(22) Filed: Jun. 3, 2008

(65) Prior Publication Data

US 2008/0304857 A1 Dec. 11, 2008

(30) Foreign Application Priority Data

Jun. 6, 2007 (JP) ..... 2007-150050

(51) Int. Cl.
*G03G 21/00* (2006.01)

(52) U.S. Cl. ..... 399/352; 399/101; 399/302

(58) Field of Classification Search ..... 399/101, 399/302

See application file for complete search history.

(56) References Cited

U.S. PATENT DOCUMENTS

2007/0286636 A1* 12/2007 Inada et al. ..... 399/101

FOREIGN PATENT DOCUMENTS

| | | |
|---|---|---|
| JP | 63-278087 | 11/1988 |
| JP | 10-010939 | 1/1998 |
| JP | 2000-276019 | 10/2000 |
| JP | 2001-125449 | 5/2001 |
| JP | 2001-350384 | 12/2001 |
| JP | 2005-003983 | 1/2005 |
| JP | 2006-201651 | 8/2006 |
| JP | 2006-276082 | 10/2006 |
| JP | 2006-337588 | 12/2006 |

OTHER PUBLICATIONS

Japanese Office Action mailed on Apr. 14, 2009 directed at counterpart application No. 2007-150050; 8 pages.

* cited by examiner

*Primary Examiner*—David M Gray
*Assistant Examiner*—Roy Yi
(74) *Attorney, Agent, or Firm*—Morrison & Foerster LLP

(57) ABSTRACT

When residual toner on the surface of an image carrier belt is removed with an elastic cleaning blade, a blade wear piece which is adhered to a blade edge is removed. When a blade edge of a cleaning blade is brought into sliding contact with a surface of an intermediate transfer belt which runs in a determined direction to remove residual toner on the belt surface, a step section having a predetermined height is provided on the surface of the intermediate transfer belt. The step section is able to pass from a rear face side to a front face side of the blade edge while allowing the blade edge to run thereon, when the belt runs in a reverse direction such that the blade edge is in sliding contact with the surface of the intermediate transfer belt. The intermediate transfer belt is moved, with a prescribed timing, in the reverse direction until the step section passes from the rear face side to the front face side of the blade edge at least once in the state that the blade edge is in sliding contact with the belt surface.

9 Claims, 5 Drawing Sheets

IMAGE FORMING APPARATUS

BACKGROUND OF THE INVENTION

The present invention relates to an electrophotographic image forming apparatus applicable to apparatuses which form monochrome images and color images, such as copying machines, facsimile machines, printers, and compound machines with these functions combined, and a method for cleaning an image carrier belt in the image forming apparatus.

In electrophotographic image forming apparatuses, as publicly known, image formation is performed by forming an electrostatic latent image by exposing the surface of a charged image carrier (e.g., drum-shaped or endless belt-like photoconductor), developing the electrostatic latent image with toner particles supplied from a developing device to form a toner image on the photoconductor, and transferring the toner image onto a paper sheet with a transfer device. As the transfer device, those having an endless belt-like image carrier belt (so-called intermediate transfer belt) are well known. In such type of transfer device, a compound color image is formed on the intermediate transfer belt by serially transferring (primarily transferring) toner images of respective colors on the photoconductor onto the intermediate transfer belt by a primary transfer roller, and transferring (secondarily transferring) the color image onto a paper sheet by a secondary transfer roller.

Since untransferred toner particles may remain on the surface of the photoconductor or the intermediate transfer belt after the transfer process, it is necessary to remove the residual toner prior to the next image formation process. As a means (cleaning means) to remove and clean up such transfer residual toner and the like from the surface of the photoconductor or the intermediate transfer belt, a method for scraping transfer residual toner and the like from a target surface using a cleaning blade made of elastic materials such as rubber or soft resin is generally and widely adopted as it is inexpensive and is easy to operate.

In the case of scraping and cleaning the transfer residual toner and the like on the image carrier belt such as endless belt-like photoconductors (photoconductor belts) and intermediate transfer belts with the cleaning blade, a sliding contact portion (blade edge) of the cleaning blade with the belt surface may wear as it rub against the advancing belt surface, and this wear piece may grow in the state of being adhered to the blade edge. This tendency is particularly notable when the hardness of the blade material is relatively low and so-called SP (solubility parameter) values of the blade material and the belt material are close. Sometimes, the wear piece may grow up into a size of about ten micrometers.

The growth of such a blade wear piece occurs downstream of the blade edge in the belt movement direction, i.e., on a blade edge rear-face side opposite to the blade edge front face side where scraped transfer residual toner is accumulated.

If the grown-up wear piece is caught between the blade edge and the belt surface, the sliding contact pressure of the blade edge applied to the belt surface becomes uneven in a belt width direction, thereby causing a problem of cleaning failure such as toner particles passing through.

For example, JP 10-10939 A, JP 2005-3983 A and JP 2001-350384 A, which do not directly discuss the problem of adhering and growth of the blade wear piece, disclose driving the belt in the direction opposite to the normal direction under fixed conditions in order to remove matter such as toner, paper powder and talc attached or deposited on the top end of the cleaning blade or its back side.

In the image forming apparatus disclosed in JP 10-10939 A, it is stated that a photoconductor belt or an intermediate transfer belt as an image carrier is moved backward after termination of rotation at the end of image formation, so as to prevent the rotation of the belt from stopping in the state that toner, paper powder and the like are adhered and accumulated on the top end of the cleaning blade, as a result of which the cleaning performance of the cleaning blade can be maintained in approximately the initial state.

However, although the image forming apparatus disclosed in JP 10-10939 A can prevent the rotation of the belt from stopping in the state that toner, paper powder and the like are adhered and accumulated on the tip (blade edge) of the cleaning blade, the adhered and accumulated toner, paper powder and the like are only released from the cleaning blade by the belt reversing drive, and there is no means to actively remove these toners, paper powder and the like from the belt surface at the time of belt reversing operation. Therefore, in this case, the toners, paper powder and the like released from the cleaning blade by the belt reversing drive are to be removed when the belt is transported again to the position facing the cleaning blade. In this structure, it is impossible to remove the blade wear piece grown in the state of being adhered to the blade edge on the downstream side of the blade edge in the regular belt movement direction.

In the image forming apparatus disclosed in JP 2005-3983 A, the photoconductor belt or the intermediate transfer belt as an image carrier is driven in the regular direction and then is temporarily driven in the reverse direction before being driven again in the regular direction. During the time the belt is driven in the reverse direction and then is again driven in the regular direction to a start position of the reverse driving, the belt and the cleaning blade are relatively moved in the belt width direction. It is stated that even if the cleaning blade has slight defects such as chips, adopting this structure can prevent the toner and paper powder on the belt from remaining in the part of the slight defects without being scraped off.

However, in this case, the belt is simply driven in the reverse direction and the belt and the cleaning blade are relatively moved in the belt width direction. Consequently, it is impossible to remove the blade wear piece grown in the state of being adhered to the blade edge on the downstream side of the blade edge in the regular belt movement direction.

Further, the image forming apparatus disclosed in JP 2001-350384 A describes the structure in which an intermediate transfer belt as an image carrier is put in pressure contact with a cleaning blade in the vicinity of the upstream of a belt driving roller. It is stated that by adopting this structure, a contact part of the belt with the blade edge is deformed in the state of being sagged due to momentary drop of the belt tension at the time of belt reverse rotation, and as the belt is reversed in this state, the rear face side of the blade edge is rubbed against the belt surface, so that talc and the like adhered and deposited on the rear face side of the blade edge can be removed.

However, it is only an instant at the time of belt reverse rotation that the rear face side of the blade edge is rubbed against the belt surface. Moreover, the rubbing force for rubbing the blade edge by the belt surface is not very strong as it simply uses the sagging of the belt. Therefore, it is insufficient for removing the blade wear piece grown in the state of being adhered to the blade edge on the downstream side of the blade edge in the regular belt movement direction.

As mentioned above, in any of the conventional technologies, it was impossible to ensure removal of the blade wear piece grown in the state of being adhered to the blade edge on the downstream side of the blade edge in the regular belt movement direction, which posed a problem of difficulty in preventing cleaning failure due to the wear piece caught between the blade edge and the belt surface.

SUMMARY OF THE INVENTION

It is an object of the present invention to provide an image forming apparatus having a cleaning blade made of an elastic member to remove residual toner on the surface of an endless image carrier belt, in which ensures removal of a blade wear piece grown in the state of being adhered to a blade edge on the downstream side in a regular belt movement direction.

Accordingly, there is provided an image forming apparatus in the present invention, including an endless image carrier belt which carries a toner image on a surface and moves in a determined direction, a cleaning blade made of an elastic member having a sliding contact portion which comes into sliding contact with the surface of the image carrier belt for removing residual toner on the surface of the image carrier belt, a drive unit which selectively moves the image carrier belt in the determined direction and in a reverse direction thereof, and a control device for controlling the drive unit, wherein a step section having a predetermined height is provided on the surface of the he image carrier belt, the step section being able to pass from a rear face side to a front face side of the cleaning blade sliding contact portion as seen from the determined direction while allowing the cleaning blade sliding contact portion to run thereon, when the image carrier belt moves in the reverse direction in a state that the cleaning blade sliding contact portion is in sliding contact with the surface of the image carrier belt, and wherein the control device controls the drive unit so that the image carrier belt is driven in the reverse direction with prescribed timing until the step section passes from the rear face side to the front face side of the sliding contact portion at least once in a state that the sliding contact portion of the cleaning blade is in sliding contact with the surface of the image carrier belt.

Moreover, there is provided, in the present invention, a cleaning method in an image forming apparatus having an endless image carrier belt which carries a toner image on a surface and moves in a determined direction, a cleaning blade made of an elastic member having a sliding contact portion which comes into sliding contact with the surface of the image carrier belt for removing residual toner on the surface of the image carrier belt, a drive unit which selectively moves the image carrier belt in the determined direction and in a reverse direction thereof, and a control device for controlling the drive unit, the cleaning method including the steps for providing a step section having a predetermined height on the surface of the image carrier belt, the step section being able to pass from a rear face side to a front face side of the cleaning blade sliding contact portion as seen from the determined direction while allowing the cleaning blade sliding section to run thereupon, when the image carrier belt moves in the reverse direction in the state that the cleaning blade sliding contact portion is in sliding contact with the surface of the image carrier belt, moving, in regular operation, the image carrier belt in the determined direction in the state that the cleaning blade sliding contact portion is in sliding contact with the surface of the image carrier belt, and driving the image carrier belt in the reverse direction with prescribed timing until the step section passes from the rear face side to the front face side of the sliding contact portion at least once in the state that the sliding contact portion of the cleaning blade is in sliding contact with the surface of the image carrier belt.

According to the present invention, the image carrier belt is moved in a reverse direction of the regular movement direction in the state that the cleaning blade sliding contact portion is in sliding contact with the surface of the image carrier belt, and while the cleaning blade sliding contact portion is allowed to run upon the step section provided on the surface of the image carrier belt, the step section can pass from the rear face side to the front face side of the sliding contact portion at least once. Consequently, in the case where there is a blade wear piece grown in the state of being adhered to the cleaning blade sliding contact portion in the downstream of the regular movement direction of the image carrier belt, the blade wear piece can certainly be scraped by the step section as the step section passes from the rear face side to the front face side while allowing the sliding contact portion to run thereupon. Therefore, it becomes possible to effectively prevent generation of cleaning failure due to the wear piece caught between the cleaning blade sliding contact portion and the surface of the image carrier belt.

DETAILED DESCRIPTION OF THE PREFERRED EMBODIMENTS

The embodiments of the present invention will be described hereinbelow with reference to the accompanying drawings.

Figure 1:
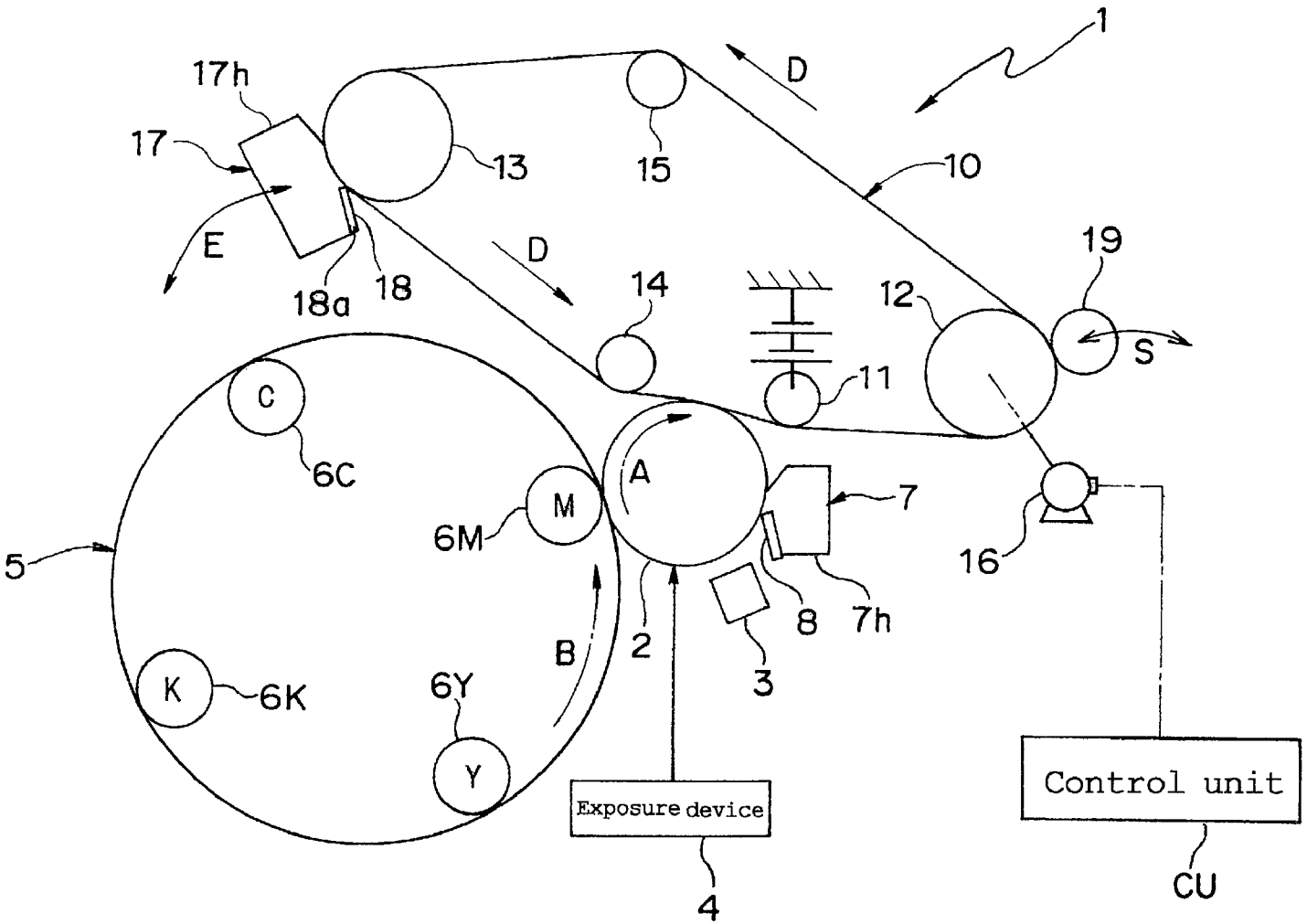
FIG. 1 is an explanatory view schematically showing the structure of an image forming apparatus in a first embodiment of the present invention.

FIG. 1 is an explanatory view schematically showing the structure of an image forming apparatus 1 in a first embodiment of the present invention. As shown in this drawing, the image forming apparatus 1 according to the present embodiment has, for example, a drum-like photoconductor 2 (photoconductor drum) which carries a toner image on its surface, and the photoconductor drum 2 can be rotated by an attached drive motor (unshown) in the direction of arrow A (clockwise direction in FIG. 1).

Around the photoconductor drum 2, a charging device 3, an exposure device 4, and a developing unit 5 are placed sequentially from the upstream side generally along the rotation direction. In the downstream of the developing unit 5, an endless transfer belt 10 (intermediate transfer belt) as an image carrier belt pressed by a primarily transfer roller 11 is in close contact with the surface of the photoconductor drum 2, and in the further downstream thereof, a first cleaning device 7 for the photoconductor drums which cleans the surface of the photoconductor drum 2 is placed.

The charging device 3, which uniformly charges the peripheral face of the photoconductor drum 2 to a predetermined electric potential, can be exemplified by corona-electrical-charging devices and the like. The exposure device 4, which is located in the downstream of the charging unit 3 in the rotation direction of the photoconductor drum 2, selectively applies light to the peripheral face of the photoconductor drum 2 for exposure, and forms an electrostatic latent image on the photoconductor drum 2.

The developing unit 5 develops the electrostatic latent image formed on the peripheral face of the photoconductor drum 2 to form a toner image. In the present embodiment, a drum type so-called four-cycle developing unit is adopted, which is composed of four developing devices 6Y, 6M, 6C, and 6K each having developer of different color placed in the circumferential direction. By rotating the developing unit 5, the photoconductor drum 2 is serially brought into contact with the developing devices of respective colors to form toner images on the photoconductor drum 2.

Accordingly, the developing unit 5 is structured as a rotatable drum type unit having developing devices 6Y, 6M, 6C, and 6K placed every 90 degrees in the circumferential direction, the developing devices 6Y, 6M, 6C, and 6K supplying toner (developer) of four colors, Y (yellow), M (magenta), C (cyan), and K (black), to the electrostatic latent image on the photoconductor drum 2 to form (develop) toner images.

Such a developing unit 5 is conventionally known and therefore its internal structure and the like are not specifically shown in the drawings. Each of the developing devices 6Y, 6M, 6C, and 6K has a developing roller (unshown) which can come into contact with the photoconductor drum 2 depending on the rotation position of the developing unit 5, so that the toner which is uniformly attached to the surface of the developing roller is then attached to the electrostatic latent image on the photoconductor 2.

The developing unit 5 rotates in the direction of arrow B in FIG. 1 in order to serially form images of the respective colors, Y, M, C, and K, on the photoconductor drum 2 in image formation. When the image forming apparatus 1 is not forming images, the developing unit 5 is in a standby state, in which the developing unit 5 is maintained in the idle state at the rotation position where neither of the developing rollers comes into contact with the photoconductor 2.

The primarily transfer roller 11 is structured so that as the primarily transfer roller 11 presses the intermediate transfer belt 10 to the photoconductor drum 2 and the intermediate transfer belt 10 thereby passes the surface of the photoconductor drum 2 in the state of being in close contact with the photoconductor drum 2, a toner image formed on the photoconductor drum 2 is transferred onto the intermediate transfer belt 10.

The first cleaning device 7 for the photoconductor drum, which is for removing the toner remaining on the photoconductor drum 2 after a toner image on the photoconductor drum 2 is transferred onto the intermediate transfer belt 10, has a housing 7*h* for collecting the residual toner on the photoconductor drum 2 and a cleaning blade 8 placed in contact with the photoconductor drum 2 in order to scrape the toner remaining on the photoconductor drum 2 by the cleaning blade 8 and to collect it in the housing 7*h*.

The intermediate transfer belt 10 is an endless belt supported by peripheral sections of two rollers 12 and 13, and is rotated in the direction of arrow D by a drive motor 16 provided to the roller 12. As described later in detail, the drive motor 16 can selectively rotate in forward and backward directions, by which it can move the intermediate transfer belt 10 selectively in a regular direction (direction of arrow D) and in a reverse direction thereof. The primarily transfer roller 11 is placed inside the intermediate transfer belt 10. It is to be noted that both remaining two rollers 14 and 15 placed inside the intermediate transfer belt 10 are for belt-tension adjustment.

In the downstream of the primarily transfer roller 11 in the rotation direction of intermediate transfer belt 10 (belt rotation direction), a secondary transfer roller 19 is located. The secondary transfer roller 19 is for secondarily transferring the toner image, which was primarily transferred from the photoconductor drum 2 onto the intermediate transfer belt 10, onto a paper sheet (unshown) as a recording medium. As shown by both-way arrow S in FIG. 1, the secondary transfer roller 19 comes into contact with the intermediate transfer belt 10 during secondary transfer, and are out of contact with the intermediate transfer belt 10 in any other occasion.

In the downstream of the secondary transfer roller in the belt rotation direction, a second cleaning device 17 for the intermediate transfer belt is provided in order to remove the toner remaining on the transfer belt 10 after the toner image on the intermediate transfer belt 10 is transferred onto the paper sheet.

The second cleaning device 17 has a housing 17*h* for collecting the residual toner on the intermediate transfer belt 10, and a cleaning blade 18 provided in contact with the intermediate transfer belt 10, so that the toner remaining on the transfer belt 10 is scraped by the cleaning blade 18 and is collected in the housing 17*h*.

The image forming apparatus 1 has a control unit CU constituted with, for example, a microcomputer as a principal component, and the control unit CU controls the operation of component members of the image forming apparatus 1. The drive motor 16 provided to the above-mentioned roller 12 is also connected to the control unit CU so as to allow signal transfer.

In the image forming apparatus 1 constituted as mentioned above, upon reception of an image signal from the outside, the control unit CU expands imaging data, while the photoconductor drum 2 is uniformly charged by the charging device 3, and then electrostatic latent images corresponding to respective colors of Y, M, C, and K are formed in an image formation region of the photoconductor drum 2 by the exposure device 4. Next, as the developing unit 5 rotates, the toner images of the respective colors, Y, M, C and K, corresponding to the electrostatic latent images are serially formed on the photoconductor drum 2. The toner images formed on the photoconductor drum 2 are transferred (primarily transferred) by the primarily transfer roller 11 one by one onto the intermediate transfer belt 10 and are superposed so that a color image is formed. The color image formed on the intermediate transfer belt 10 is transferred (secondary transferred) by the secondary transfer roller 19 onto a predetermined paper sheet.

The toner (transfer residual toner) remaining on the intermediate transfer belt 10 after the color image on the intermediate transfer belt 10 is transferred onto the paper sheet is scraped by the cleaning blade 18 of the second cleaning device 17 and is collected in the housing 17*h*.

In the present embodiment, image formation is performed by a so-called four-cycle development system. Therefore in this image formation process, as shown by both-way arrow E in FIG. 1, the separation/pressure contact operation of the second cleaning device 17 (and therefore that of the cleaning blade 18) with respect to the intermediate transfer belt 10 is repeated with predetermined timing in order to superpose four colors on the intermediate transfer belt 10. That is, the cleaning blade 18 is isolated from the intermediate transfer belt 10 during image formation, and at the time after the images of four colors are superposed and transferred onto the paper sheet, the cleaning blade 18 is put in pressure contact with the intermediate transfer belt 10.

The intermediate transfer belt 10 is manufactured through molding process with use of widely used materials such as polycarbonate resin. The hardness of this polycarbonate resin is about M60-M75 in Rockwell hardness.

The cleaning blade 18 is manufactured with use of widely used materials such as polyurethane rubber, which has a hardness of around 70 measured by the measuring method specified by JIS K6301. The SP (solubility parameter) value of polyurethane is approx. ten. It is to be noted that the SP value, which is a numerical value serving as an index showing the solvency into solvent and the like, is expressed as a square root of Cohesive Energy Density (CED). The CED represents the amount of energy taken to evaporate a substance of 1 milliliter (ml).

When the transfer residual toner and the like on the intermediate transfer belt 10 are scraped and cleaned by the cleaning blade 18 as an elastic member, the sliding contact portion (blade edge) of the cleaning blade 18 with the belt surface is worn out by rubbing with the moving belt surface as mentioned above, and the wear piece may grow in the state of being adhered to the blade edge in the downstream of the blade edge (blade edge rear face side) in the belt movement direction. In particular, the hardness of the blade material of the cleaning blade 18 is as low as around 70, and therefore in the case of using the belt material having a SP value (e.g., about 8 to 12) close to the SP value of the blade material (approx. 10), there is a possibility that the tendency may become more notable.

If the grown-up wear piece is caught between the blade edge and the belt surface, the sliding contact pressure of the blade edge applied to the belt surface becomes uneven in a belt width direction, thereby causing a problem of cleaning failure such as toner particles passing through.

Since the so-called four-cycle development system is adopted in the present embodiment, and the separation/pressure contact operation of the cleaning blade 18 with respect to the intermediate transfer belt 10 is repeated as mentioned above in the image formation process. Accordingly, the blade wear piece tends to be caught between the blade edge and the belt surface when the pressure contact operation is performed after the separation operation.

Figure 2:
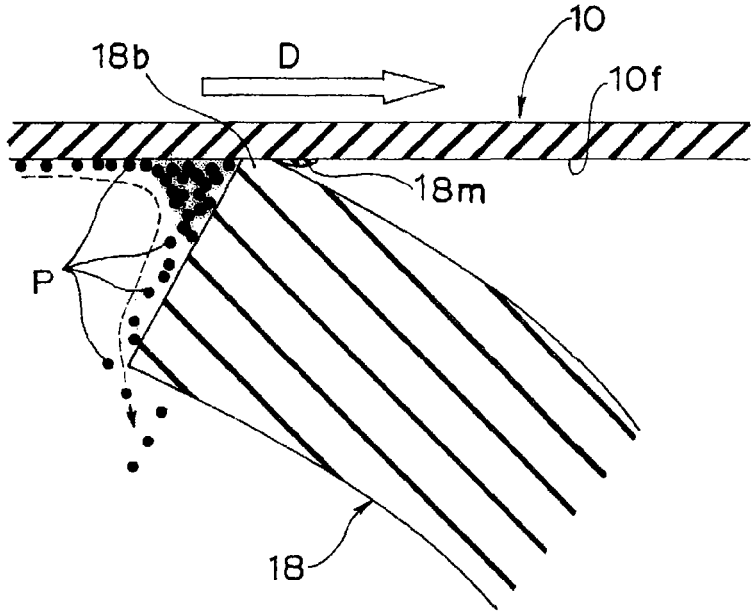
FIG. 2 is a part of a series of explanatory views schematically showing a blade wear piece being caught between a blade edge and a belt surface.
Figure 3:
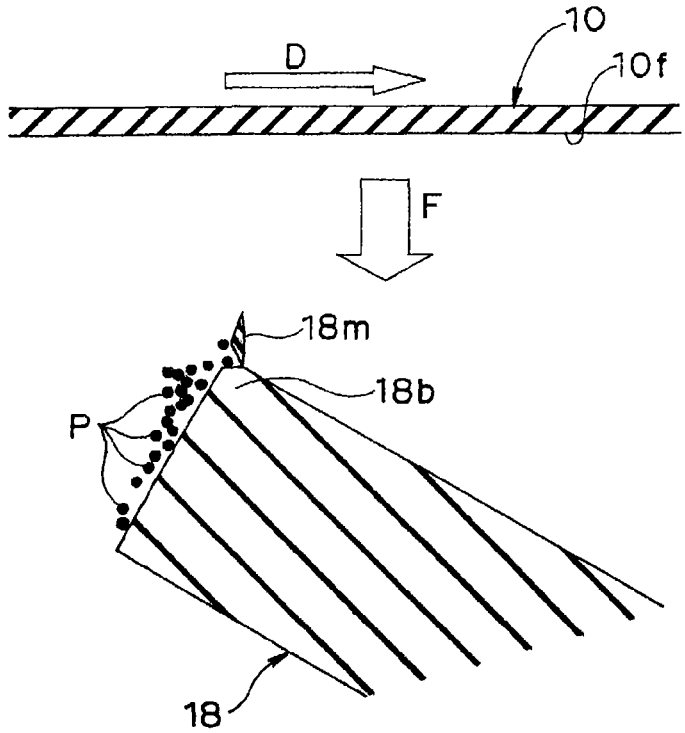
FIG. 3 is a part of a series of explanatory views schematically showing a blade wear piece being caught between a blade edge and a belt surface.
Figure 4:
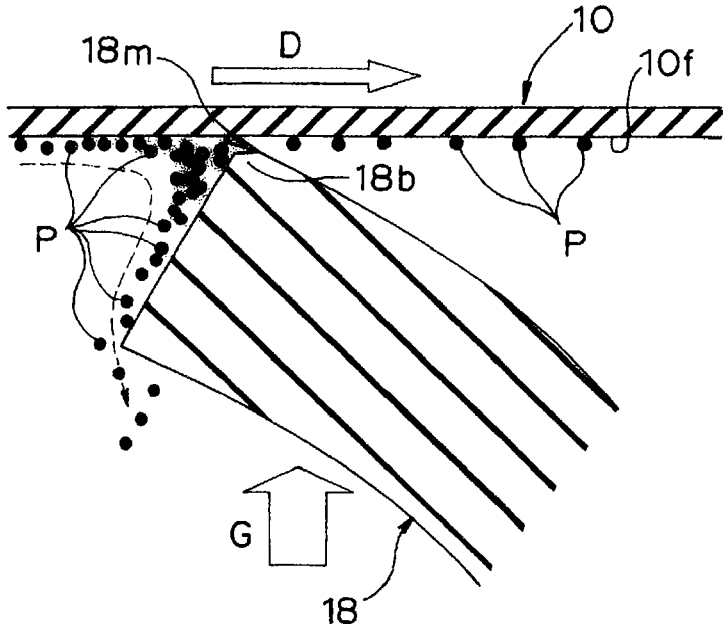
FIG. 4 is a part of a series of explanatory views schematically showing a blade wear piece being caught between a blade edge and a belt surface.

FIG. 2 to FIG. 4 are a series of explanatory views schematically showing the states of a blade wear piece being caught between the blade edge and the belt surface when the pressure contact operation is operated after the cleaning blade is separated from the intermediate transfer belt.

As shown in FIG. 2, as the intermediate transfer belt 10 moves in the regular direction (direction of arrow D), a blade edge 18*b* of the cleaning blade 18 scrapes transfer residual toner P while coming into sliding contact with a surface 10*f* of the intermediate transfer belt 10, and the scraped transfer residual toner P is accumulated on the upstream side of the blade edge 18*b* (blade edge front face side) in the belt movement direction D. At this time, the blade edge 18*b* is worn out by rubbing with the surface of the moving belt, and a wear piece 18*m* may grow in the state of being adhered to the blade edge 18*b* on the downstream side of the blade edge 18*b* (blade edge rear face side) in the belt movement direction D.

If the cleaning blade 18, with the thus-grown wear piece 18*m* adhered thereto, is temporarily separated from the belt surface 10*f* in the direction of arrow F in FIG. 3, and then is put in pressure contact with the belt surface 10*f* again as shown by arrow G in FIG. 4, the blade wear piece 18*m* may be caught between the blade edge 18*b* and the belt surface 10*f*. If the blade wear piece 18*m* is caught in this way, the sliding contact pressure of the blade edge 18*b* applied to the belt surface 10*f* become uneven in a belt width direction, thereby causing cleaning failure such as toner particles P passing through. If the toner particles P pass through, then an unwiped area is left over on both sides of the part where the blade wear piece 18*m* was caught, and appears as printing failure in the shape of a stripe.

In the present embodiment, a step section with a predetermined height is provided on the surface 10*f* of the intermediate transfer belt 10, the step section being able to pass from the rear face side to the front face side of the blade edge 18*b* while allowing the blade edge 18*b* to run thereupon, when the intermediate transfer belt 10 runs in the direction opposite to the regular movement direction (direction of arrow D) in the state that the blade edge 18*b* is in sliding contact with the surface 10*f* of the intermediate transfer belt 10. The blade wear piece 18*m* is surely scraped with use of the step section.

Figure 5:
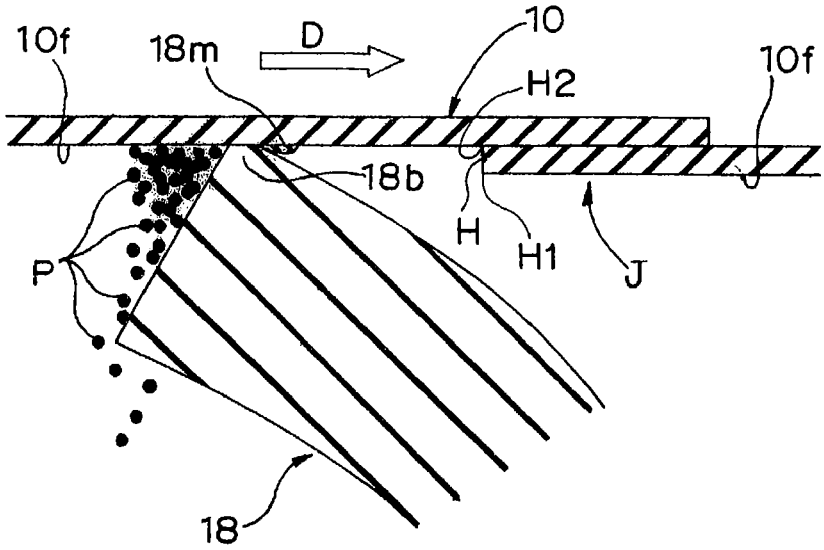
FIG. 5 is a cross sectional view schematically showing the structure of a step section of an intermediate transfer belt in the first embodiment.

That is, as shown in FIG. 5, a seam section J formed by laying and joining terminal sections of a belt material is formed on the intermediate transfer belt 10, and the seam section J has a step section H having a height corresponding to the thickness of the belt material (e.g., about 150 micrometers). Since the step section H is formed by laying the terminal sections of the belt material, the step section H has a vertical wall surface extending in the direction perpendicular to a belt conveying direction. The vertical wall surface is formed facing the rear face side of the cleaning blade 18.

The cleaning blade 18 has the blade edge 18*b* in one end side, while an end section 18*a* (see FIG. 1) on the other end side is fixed to a housing 17*h* of the second cleaning device 17 so as to be supported like a cantilever. And the blade support end section 18*a* is located on the rear face side of the blade edge 18*b* (downstream side of the intermediate transfer belt 10 in the regular movement direction (direction of arrow D)) from the point of contact of the blade edge 18*b* with the surface 10*f* of the intermediate transfer belt 10. The step section H is positioned so that a top end H1 is closer than a starting end H2 to the support end section 18*a* of the cleaning blade 18 (lower side in FIG. 5).

When the step section H passes the blade edge 18*b* while the intermediate transfer belt 10 moves in the regular direction, the blade edge 18*b* falls from the top end H1 side to the starting end H2 side of the step section H, so that the blade edge 18*b* is displaced onto the belt surface which is flush with the starting end H2 of the step section H. Consequently, the cleaning blade 18 is swung to the belt side with the support end section 18*a* as a center. Thus, the step section H passes from the front face side to the rear face side of the blade edge 18*b*.

Therefore, as long as the intermediate transfer belt 10 runs in the regular direction (direction of arrow D), the step section H will not perform the function of scraping foreign objects caught therein even though it may exert some impact, caused by the blade edge 18*b* falling from the step section H, on the cleaning blade 18.

Figure 6:
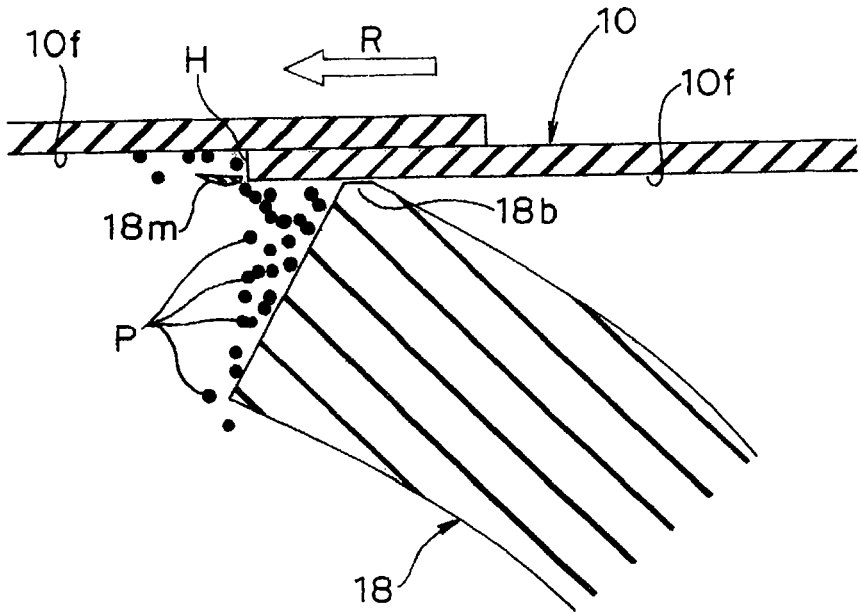
FIG. 6 is a cross sectional view showing the state where the step section has scraped a blade wear piece.

However, by moving the intermediate transfer belt 10 in the direction (direction of arrow R) opposite to the regular movement direction (direction of arrow D in FIG. 5), as shown in FIG. 6, for example after termination of image formation and the like, the step section H may pass from the rear face side to the front face side of the blade edge 18*b* (i.e., in the direction of arrow R), while allowing the blade edge 18*b* to run upon the step section H. Thus, when the intermediate transfer belt 10 moves in the reverse direction and the blade edge 18*b* runs upon the step section H, the rear face of the cleaning blade 18 is pressed by the top end H1 of the step section H, and the cleaning blade 18 swings to the opposite side of the belt with the blade support end section 18*a* as a center. Consequently, the cleaning blade sliding contact portion 18*b* is displaced to the side of the top end H1 of the step section H, and comes into sliding contact with the belt surface which is flush with the top end H1.

In the case where the blade wear piece 18*m* grown in the state of being adhered to the rear face side of the blade edge 18*b* exists, the blade wear piece 18*m* can certainly be scraped by the step section H as the step section H passes from the rear face side to the front face side while allowing the blade edge 18*b* to run thereupon. Therefore, it becomes possible to effectively prevent generation of the cleaning failure due to the wear piece 18*m* caught between the blade edge 18*b* and the belt surface 10*f*.

In this case, since the blade wear piece 18*m* is scraped by using the step section H in the seam section J formed on the intermediate transfer belt 10, it is not necessary to provide anew the step section which performs this function separately, so that the above-mentioned effect can be obtained easily at low costs.

As mentioned above, the cleaning blade 18 is made of polyurethane rubber (hardness is around about 70 by the measuring method based on JIS K6301), whereas the intermediate transfer belt 10 is made of polycarbonate resin (hardness is about M60-M75 in Rockwell hardness), indicating large difference in hardness therebetween. Therefore, it becomes possible to ensure scraping of the blade wear piece 18*m* by making the step section H cut off the blade wear piece 18*m* when the step section H passes from the rear face side to the front face side while allowing the blade edge 18*b* to run thereupon.

Since the position of the seam section J of the intermediate transfer belt 10 can be identified beforehand, it is so set that the toner image on the photoconductor drum 2 may not be transferred onto the seam section J and the area nearby. That is, since the step section H for scraping the blade wear piece 18*m* is set to be in a region which does not interfere with the region where transfer is performed, i.e., set to be in a region excluding the image formation region, the step section H will not disturb the image formation using the intermediate transfer belt 10.

Such reverse driving of the intermediate transfer belt 10 is performed by driving the drive motor 16 in the direction opposite to the normal direction in response to a control signal from the control unit CU.

The intermediate transfer belt 10 should preferably be reversed at the point when all the necessary image formation is finished, or whenever specified number of printing (e.g., thousands of sheets) is finished.

The drive motor 16 is controlled so that the reverse driving of the intermediate transfer belt 10 is continued until the step section H passes from the rear face side to the front face side of the blade edge 18*b* (i.e., in the direction of arrow R) at least once.

In the case where conditions which enable the step section H to certainly scrape the blade wear piece 18*m* are met, the conditions including the height of the step section H, the difference in hardness between the intermediate transfer belt 10 and the cleaning blade 18, the relationship between the angle of contact of the cleaning blade 18 with the belt surface 10*f* and the angle of the step section H, and the timing of reverse driving of the intermediate transfer belt 10 or the movement speed of the belt at the time of reverse driving, then the intermediate transfer belt 10 has only to be reversed so that the step section H may pass from the rear face side to the front face side of the blade edge 18*b* (i.e., in the direction of arrow R) only once.

Depending on each of the conditions, forward driving (running in the regular direction) and reverse driving may be repeated so that the step section H may repeatedly pass from the rear face side to the front face side of the blade edge 18*b* a plurality of times. In this case, it is not necessary to rotate the intermediate transfer belt 10 all the way around 360 degrees, but rather the forward driving and the reverse driving should just be repeated before and after the point where the step section H passes from the rear face side to the front face side of the blade edge 18*b*.

As the angle of the step section H becomes closer to right angles with the belt surface 10*f*, the effect of scraping the blade wear piece 18*m* becomes larger and more preferable. In the case where the step section H has a sufficient height, the step section H may be inclined so that the front side may gradually be lowered in reverse driving of the belt from the viewpoint of promoting the blade edge 10*b* to run upon the step section H. In this case, since the angle of contact of the cleaning blade 18 with the belt surface 10*f* is generally 20 to 30 degrees, it is necessary to set the angle of gradient larger than the angle of contact. Therefore, the angle of gradient of the step section H should be set to at least 30 degrees or more, and more preferably to 45 degrees or more (and 90 degrees or less).

The height of the step section H should preferably be 10 micrometers or more. If the height of the step section H is 10 micrometers or more, the effect of scraping the blade wear piece 18*m* is achieved by one reverse driving of the intermediate transfer belt 10 against dozens of forward driving of the belt 10. In particular, if the height of the step section H is 20 micrometers or more, frequency of the reverse driving against the number of times of forward driving of the intermediate transfer belt 10 can be reduced further. When the frequency of reverse driving of the intermediate transfer belt 10 is increased, wear of the blade edge 18*b* is promoted and the life of the cleaning blade 18 may be shortened instead.

When the height of the step section H is too large and is beyond 200 micrometers, it is possible to reduce the frequency of the reverse driving of the intermediate transfer belt 10, although the force applied to the blade edge 10*b* may become excessive, and a local damage may be caused.

Therefore, it is desirable to set the height of the step section H within the limits of 20 micrometers or more and 200 micrometers or less.

Moreover, the larger the belt movement speed in reverse driving of the intermediate transfer belt 10 becomes, the larger the effect of scraping the blade wear piece 18*m* becomes. If the height of the step section H is about 10 micrometers, it is desirable to set the belt speed of reverse driving to about 100 mm/sec or more from the viewpoint of ensuring implementation of the effect of scraping the blade wear piece 18*m*. However, the speed of reverse driving may be decreased as long as the step section H has a sufficient height. It is to be noted, however, that if the reverse driving speed of the intermediate transfer belt 10 becomes too slow, the step section H may fail to tear off (or cut off) the blade wear piece 18*m*, as a result of which the blade wear piece 18*m* may end up being dragged in between the belt surface 10*f* and the blade edge 10*b*. Therefore, the minimum value of the reverse driving speed of the intermediate transfer belt 10 should preferably be set according to the height of the step section H.

It is to be noted that the growth of the blade wear piece 18*m* is also influenced by the amount of toner particles P which reach the blade edge 18*b*. Therefore, it is desirable to appropriately adjust the reverse driving frequency and the like of the intermediate transfer belt 10 according to an image pattern and the like. Further, since the growth of the blade wear piece 18*m* is accelerated under the environment of high-humidity/temperature, it is still more desirable to appropriately adjust the reverse driving frequency and the like of the intermediate transfer belt 10 in response to such an environmental condition.

Description is now given of a second embodiment of the present invention.

It is to be noted that component members similar in structure and function to those in the first embodiment are designated by similar reference numerals to omit further description.

Figure 7:
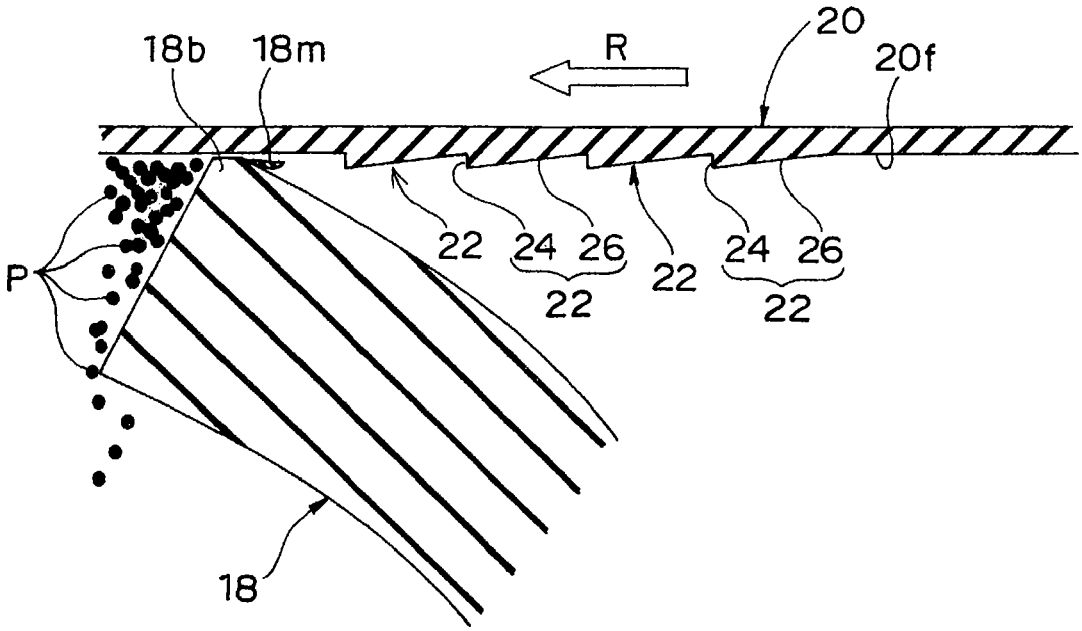
FIG. 7 is a cross sectional view schematically showing the structure of a step section of an intermediate transfer belt in a second embodiment of the present invention.

FIG. 7 is a cross sectional view showing the schematic structure of a step section of an intermediate transfer belt 20 according to the second embodiment of the present invention. As shown in this drawing, in the second embodiment, a step section 22 in the shape of a saw blade having an inclined part 26, which becomes higher toward the belt reverse driving direction (direction of arrow R), is formed on a surface 20*f* of the intermediate transfer belt 20. Each of the step sections 22 is composed of the inclined part 26 and a vertical wall part 24 which extends from the top part of the inclined part 26 at approximately right angles with the belt surface 20*f*. This vertical wall part 24 has the same function as the vertical wall of the step section H in the first embodiment. In other words, four step sections 22 are formed in succession with the inclined part 26 on the downstream side and the vertical wall part 24 on the upstream side in the direction of belt forward driving.

In the present embodiment, when the intermediate transfer belt 20 runs forward, the blade edge 18*b* moves relatively along with the inclined part 26 in each of the step sections 22, so that the blade edge 18*b* can pass each of the step sections 22 relatively smoothly and so the wear of the blade edge 18*b* can be suppressed. When the intermediate transfer belt 20 runs backward as shown in FIG. 7, the blade wear piece 18*m* can effectively be scraped by the vertical wall part 24 of each of the step sections 22. Although a plurality of the step sections 22 are provided in the example of FIG. 7, only one step section 22 may be provided instead.

In the intermediate transfer belt 20 according to the second embodiment, the step section 22 can simultaneously be formed during molding of the belt 20 by providing a shape of the surface corresponding to the step section in a belt forming die. Thus, even when a so-called seamless type belt without any seam section is used as the intermediate transfer belt 20, the step section 22 for effectively scraping the blade wear piece 18*m* can still be provided.

Figure 8:
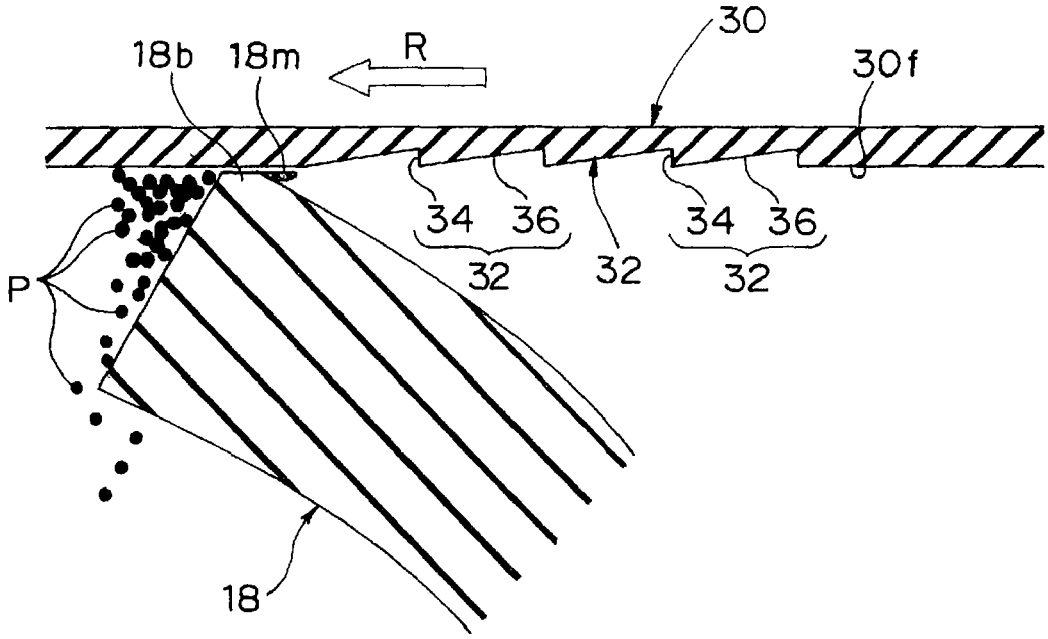
FIG. 8 is a cross sectional view schematically showing the structure of a step section of an intermediate transfer belt in a third embodiment of the present invention.

FIG. 8 is a cross sectional view showing the schematic structure of a step section of an intermediate transfer belt 30 according to a third embodiment of the present invention. The third embodiment constitutes a modification of the second embodiment, in which a step section 32 of the intermediate transfer belt 30 is formed not by molding but by machining such as cutting.

In this case, although it is generally impossible to make the top portion of a vertical wall part 34 (i.e., top portion of an inclined part 36) higher than a belt surface 30*f*, the same function and effect as the case in the second embodiment can still be obtained if the shape of the step section 32 and the height of the vertical wall part 34 are identical.

Figure 9:
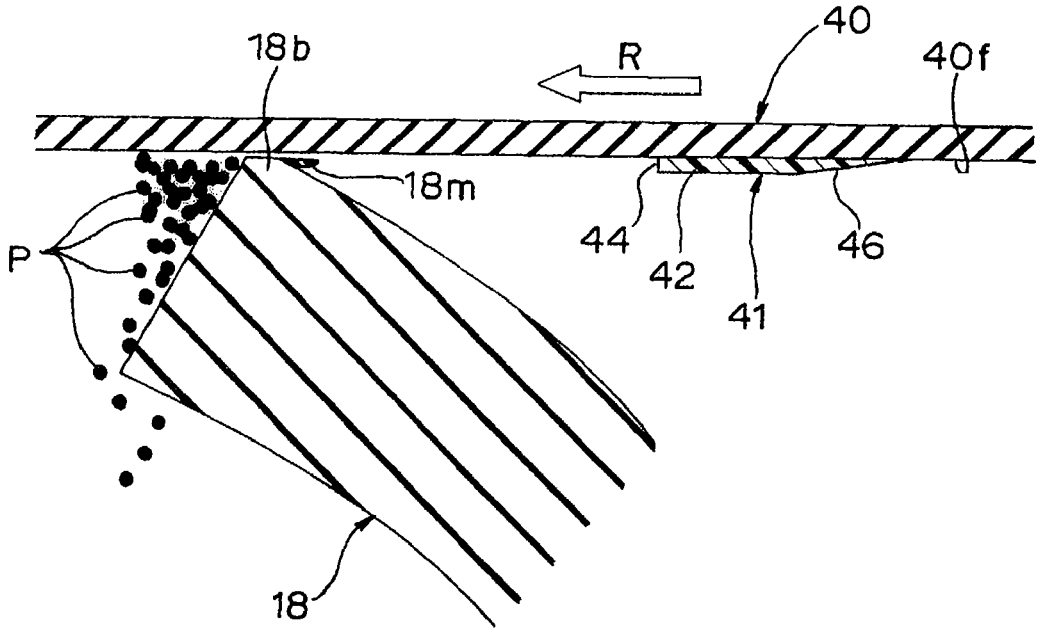
FIG. 9 is a cross sectional view schematically showing the structure of a step section of an intermediate transfer belt in a fourth embodiment of the present invention.

FIG. 9 is a cross sectional view showing the schematic structure of a step section of an intermediate transfer belt 40 according to a fourth embodiment of the present invention. As shown in the drawing, in the fourth embodiment, a step section 42 is post-installed by pasting a sheet material 41 with a prescribed thickness on a surface 40*f* of the intermediate transfer belt 40. The pasting is achieved with use of an adhesive bond or through welding.

The step section 42 is provided with an inclined part 46 which becomes higher in the belt reverse driving direction (direction of arrow R), and a vertical wall part 44 formed in an end portion on the opposite side of the inclined part 46. Therefore, with respect to the shape of the step section 42, the same function and effect as the second and the third embodiments can be obtained. Furthermore in the present embodiment, since the sheet material 41 is produced through a process independent of the molding of the belt 40 and the step section 42 is post-installed, the accuracy of the setup position of the step section 42 as well as the form accuracy of the step section 42 can be enhanced more.

Although the embodiments disclosed above involve the intermediate transfer belt equipped with the step section for effectively scraping the blade wear piece 18*m*, the present invention is not limited to the embodiments disclosed, but can effectively be applied to the case, for example, where the photoconductor is constituted from an endless belt serving as an image carrier belt, in which a blade wear piece adhering to the blade edge of a cleaning blade for removing transfer residual toner thereof is scraped and removed.

Thus, it should naturally be understood that the embodiments described herein are therefore not restrictive, and various modifications and variations in design without departing from the scope of the present invention are possible.

What is claimed is:

1. An image forming apparatus, comprising:

an endless image carrier belt which carries a toner image on a surface and moves in a determined direction;

a cleaning blade made of an elastic member having a sliding contact portion which comes into sliding contact with the surface of the image carrier belt for removing residual toner on the surface of the image carrier belt;

a drive unit which selectively moves the image carrier belt in the determined direction and in a reverse direction thereof; and a control device for controlling the drive unit, wherein a step section having a predetermined height is provided on the surface of the image carrier belt, the step section being able to pass from a rear face side to a front face side of the cleaning blade sliding contact portion as seen from the determined direction while allowing the cleaning blade sliding contact portion to run thereon, when the image carrier belt moves in the reverse direction in a state that the cleaning blade sliding contact portion is in sliding contact with the surface of the image carrier belt, and wherein the control device controls the drive unit so that the image carrier belt is driven in the reverse direction with prescribed timing until the step section passes from the rear face side to the front face side of the sliding contact portion at least once in a state that the sliding contact portion of the cleaning blade is in sliding contact with the surface of the image carrier belt.

2. The image forming apparatus according to claim 1, wherein the cleaning blade has the sliding contact portion in one end side while being supported by a supporting part like a cantilever on the other end side, and the cleaning blade supporting part is positioned on the rear face side of the cleaning blade from a point of contact between the sliding contact portion and the image carrier belt, wherein the step section is positioned so that a top end is closer than a starting end to the cleaning blade supporting part, and wherein when the image carrier belt moves in the reverse direction and the cleaning blade sliding contact portion runs upon the step section, the rear face of the cleaning blade is pressed by the top end of the step section so that the cleaning blade is swung with the supporting part as a center and the cleaning blade sliding contact portion is displaced to the top end side of the step section.

3. The image forming apparatus according to claim 1, wherein the image carrier belt is an intermediate transfer belt for primarily transferring a toner image on the photoconductor and secondarily transferring the primarily transferred toner image onto a predetermined recording medium, and wherein the step section is provided in a region except an image formation region.

4. The image forming apparatus according to claim 1, wherein the step section is constituted by a seam section of the belt.

5. The image forming apparatus according to claim 1, wherein the step section is formed into a saw blade shape having an inclined part which becomes higher toward the reverse direction.

6. The image forming apparatus according to claim 1, wherein the step section is formed from a sheet material with a prescribed thickness pasted on the belt.

7. The image forming apparatus according to claim 1, wherein the predetermined height of the step section is 20 micrometers or more and 200 micrometers or less.

8. The image forming apparatus according to claim 1, wherein the cleaning blade is distanced from the image carrier belt with second prescribed timing.

9. A method for cleaning an image carrier belt in an image forming apparatus, the image forming apparatus comprising:

an endless image carrier belt which carries a toner image on a surface and moves in a determined direction;

a cleaning blade made of an elastic member having a sliding contact portion which comes into sliding contact with the surface of the image carrier belt for removing residual toner on the surface of the image carrier belt;

a drive unit which selectively moves the image carrier belt in the determined direction and in a reverse direction thereof; and a control device for controlling the drive unit, the cleaning method comprising the steps for:

providing a step section having a predetermined height on the surface of the image carrier belt, the step section being able to pass from a rear face side to a front face side of the cleaning blade sliding contact portion as seen from the determined direction while allowing the cleaning blade sliding to run thereon, when the image carrier belt moves in the reverse direction in a state that the cleaning blade sliding contact portion is in sliding contact with the surface of the image carrier belt;

moving, in regular operation, the image carrier belt in the determined direction in a state that the cleaning blade sliding contact portion is in sliding contact with the surface of the image carrier belt; and driving the image carrier belt in the reverse direction with prescribed timing until the step section passes from the rear face side to the front face side of the sliding contact portion at least once in a state the sliding contact portion of the cleaning blade is in sliding contact with the surface of the image carrier belt.

* * * * *